US008556663B2

(12) United States Patent
Geng et al.

(10) Patent No.: US 8,556,663 B2
(45) Date of Patent: Oct. 15, 2013

(54) USB JACK AND USB PLUG

(75) Inventors: Chao Geng, Wuhan (CN); Qiu-Hua Bin, Wuhan (CN); Xiang Zhang, Wuhan (CN)

(73) Assignees: Hong Fu Jin Precision Industry (WuHan) Co., Ltd., Wuhan (CN); Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/426,738

(22) Filed: Mar. 22, 2012

(65) Prior Publication Data

US 2012/0295488 A1 Nov. 22, 2012

(30) Foreign Application Priority Data

May 17, 2011 (CN) ..... 2011 1 0127422

(51) Int. Cl.
*H01R 24/00* (2011.01)

(52) U.S. Cl.
USPC ..... 439/660

(58) Field of Classification Search
USPC ..... 439/660, 638, 108, 79, 357, 578
See application file for complete search history.

(56) References Cited

U.S. PATENT DOCUMENTS

| | | | | | |
|---|---|---|---|---|---|
| 3,986,766 | A * | 10/1976 | Sochor | 439/660 |
| 5,221,212 | A * | 6/1993 | Davis | 439/108 |
| 5,267,881 | A * | 12/1993 | Matuzaki | 439/660 |
| 5,454,734 | A * | 10/1995 | Eggert et al. | 439/578 |
| 6,062,892 | A * | 5/2000 | Meng et al. | 439/357 |
| 6,095,861 | A * | 8/2000 | Lin et al. | 439/607.25 |
| 6,334,793 | B1 * | 1/2002 | Amoni et al. | 439/680 |
| 7,354,282 | B2 * | 4/2008 | Margulis et al. | 439/79 |
| 7,654,871 | B2 * | 2/2010 | Yi et al. | 439/660 |
| 7,744,423 | B2 * | 6/2010 | Funahashi | 439/638 |
| 7,841,894 | B2 * | 11/2010 | Gong et al. | 439/541.5 |
| 8,007,320 | B1 * | 8/2011 | Zhang et al. | 439/638 |
| 8,052,476 | B2 * | 11/2011 | Zheng et al. | 439/660 |
| 2007/0049115 | A1 * | 3/2007 | Igarashi et al. | 439/607 |

* cited by examiner

*Primary Examiner* — Alexander Gilman
(74) *Attorney, Agent, or Firm* — Altis & Wispro Law Group, Inc.

(57) ABSTRACT

A USB jack includes a case and an installation plate. The case is adapted for receiving a USB plug and includes a top wall and a bottom wall opposite to the top wall. The installation plate is located in the case and between the top wall and the bottom wall. A number of first pins is secured to a top surface of the installation plate facing the top wall, and a number of second pins is secured to a bottom surface of the installation plate facing the bottom wall. The number of first pins and the number of second pins abut a plurality of resilient pieces of the USB plug and are electronically connected with the plurality of resilient pieces of the USB plug along two opposite directions. A USB plug corresponding to the USB jack is further disclosed.

11 Claims, 4 Drawing Sheets

USB JACK AND USB PLUG

BACKGROUND

1. Technical Field

The present disclosure relates to USB jack and USB plugs, and particularly to a USB 3.0 jack and a USB 3.0 plug.

2. Description of Related Art

USB 3.0 jacks and USB 3.0 plugs are connected together by a number of tuning fork contacts. When the USB 3.0 plug is inserted into the USB 3.0 jack, an inserting force may easily become greater than what is tolerated in a specification. Thus the USB 3.0 jack and the USB 3.0 plug may become unstably connected with each other.

Therefore, there is room for improvement in the art.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
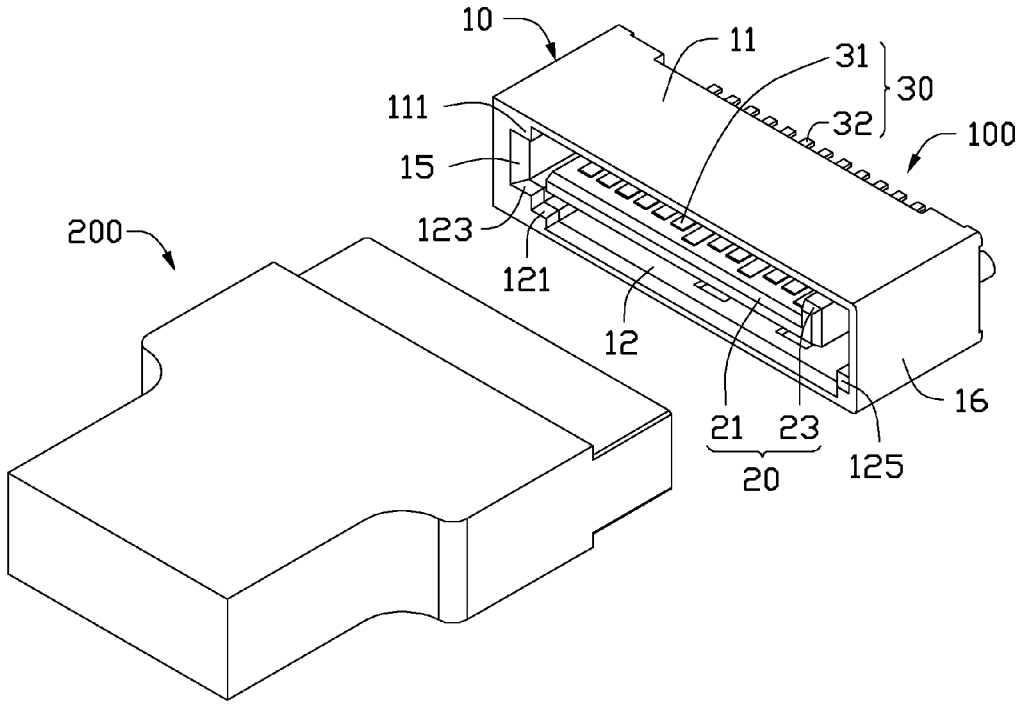
FIG. 1 is an exploded, isometric view of an embodiment of a USB jack and a USB plug.
Figure 2:
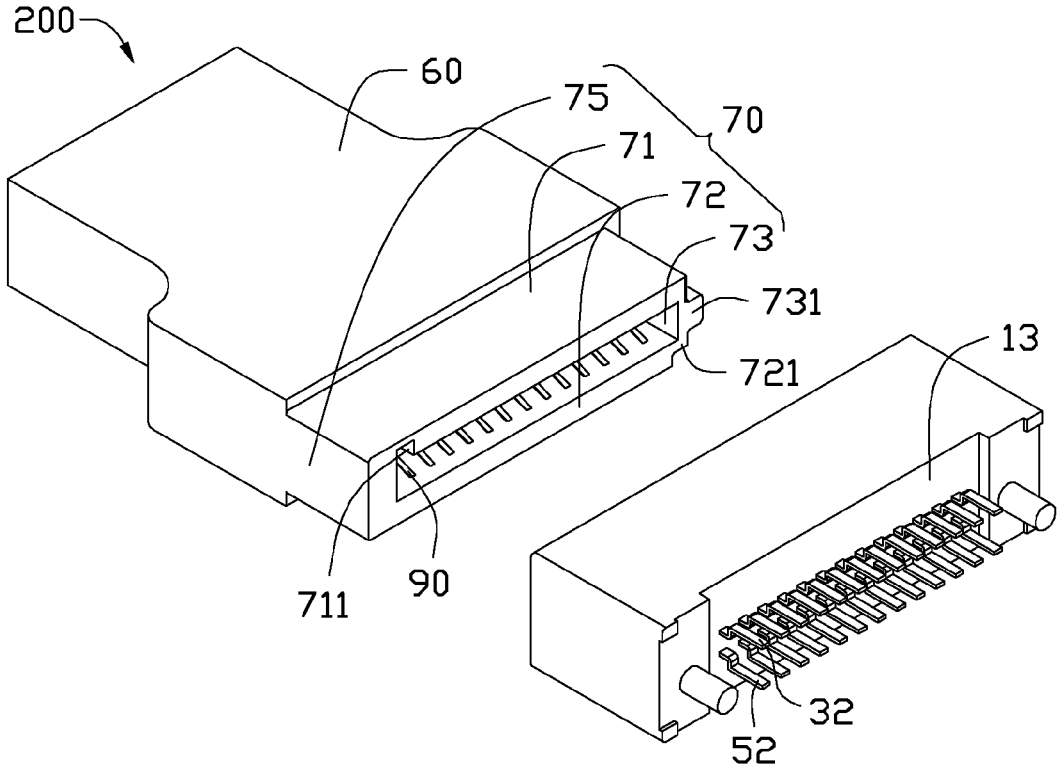
FIG. 2 is similar to FIG. 1, but viewed from a different aspect.

FIG. 1 and FIG. 2, show a USB jack in accordance with an embodiment including a case 10 and an installation portion 20 located on the case 10.

The case 10 includes a top wall 11, a bottom wall 12, a rear wall 13, a first sidewall 15 and a second sidewall 16 opposite to the first sidewall 15. In one embodiment, the rear wall 13 is substantially perpendicular to the top wall 11 and the bottom wall 12, and the first sidewall 15 is substantially perpendicular to the top wall 11 and the rear wall 13. The installation portion 20 includes an installation plate 21 and an installation piece 23. The installation plate 21 extends from the rear wall 13 and is substantially perpendicular to the rear wall 13. The installation piece 23 extends from a side edge of the installation plate 21 and is substantially perpendicular to the installation plate 21. A plurality of first pins 30 is secured to a top surface of the installation plate 21 facing the top wall 11. A plurality of second pins 50 are secured to a bottom surface of the installation plate 21 facing the bottom wall 12. Each of the plurality of first pins 30 includes a first end 31 and a second end 32 opposite to the first end 31. The first end 31 is secured to the installation plate 21. The second end 32 is inserted out of the case 10 through the rear wall 13. Each of the plurality of second pins 50 includes a third end 51 and a fourth end 52 opposite to the third end 51 (referring to FIG. 2 and FIG. 4).

The third end 51 is secured to the installation plate 21. The fourth end 52 is inserted out of the case 10 through the rear wall 13. The second end 32 and the fourth end 52 are secured to a circuit board (not shown). A first limiting block 111 is located in a first corner between the top wall 11 and the first sidewall 15. A second limiting block 121 is located in a second corner between the bottom wall 12 and the first sidewall 15. A third block 123 extends from the second limiting block 121. A fourth limiting block 125 is located in a third corner between the bottom wall 12 and the second sidewall 16. In one embodiment, the plurality of first pins 30 and the plurality of second pins 50 can be connected to a USB 2.0 plug or a USB 3.0 plug, a number of the plurality of first pins 30 is 13, and the number of second pins 50 is 13.

FIG. 2, shows a USB plug 200 in accordance with an embodiment including a connection end 60 and insertion end 70 connected to the connection end 60.

The insertion end 70 includes a top plate 71, a bottom plate 72, a first side plate 73 and a second side plate 75. In one embodiment, the top plate 71 is substantially parallel to the bottom plate 72, the first side plate 73 is substantially parallel to the second side plate 75 and substantially perpendicular to the top plate 71. A plurality of first resilient pieces 80 is secured to a bottom surface of the top plate 71 facing the bottom plate 72 (referring to FIG. 4). A slot 711 is defined in the top plate 71 and extends to the second side plate 75. A plurality of second resilient pieces 90 is secured to a top surface of the bottom plate 72 facing the top plate 71. The plurality of second resilient pieces 90 is similar to the plurality of first resilient pieces 80. In one embodiment, the plurality of first resilient pieces 80 and plurality of second resilient pieces 90 are arched. A first positioning block 731 extends from the first side plate 73. A second positioning block 721 is located on the bottom plate 72. In one embodiment, the USB plug 200 can be a USB 2.0 plug or a USB 3.0 plug, the number of first resilient pieces 80 is 13, and the number of the plurality of second resilient pieces 90 is 13.

Figure 3:
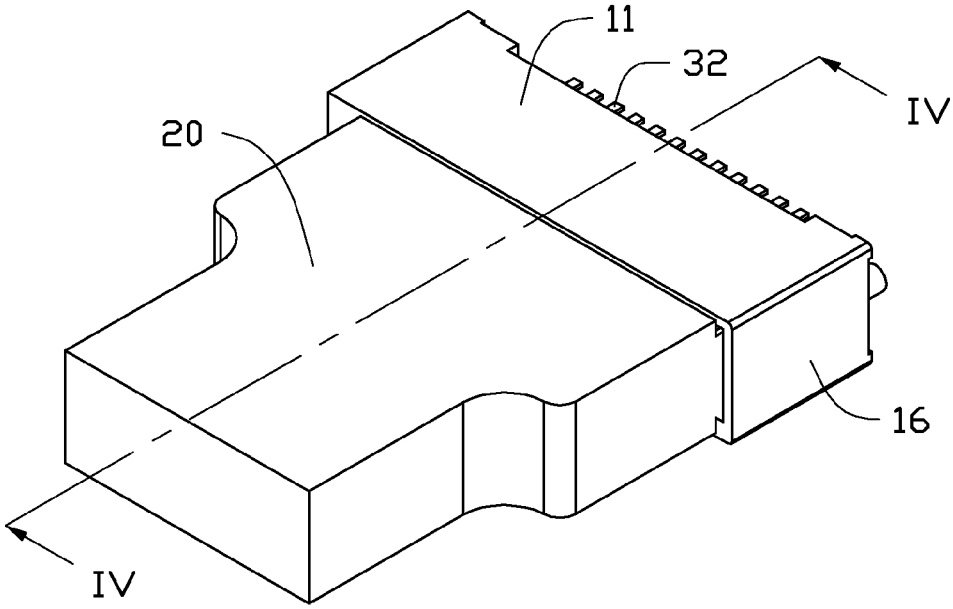
FIG. 3 is an isometric view of the assembled USB jack and USB plug of FIG. 1.
Figure 4:
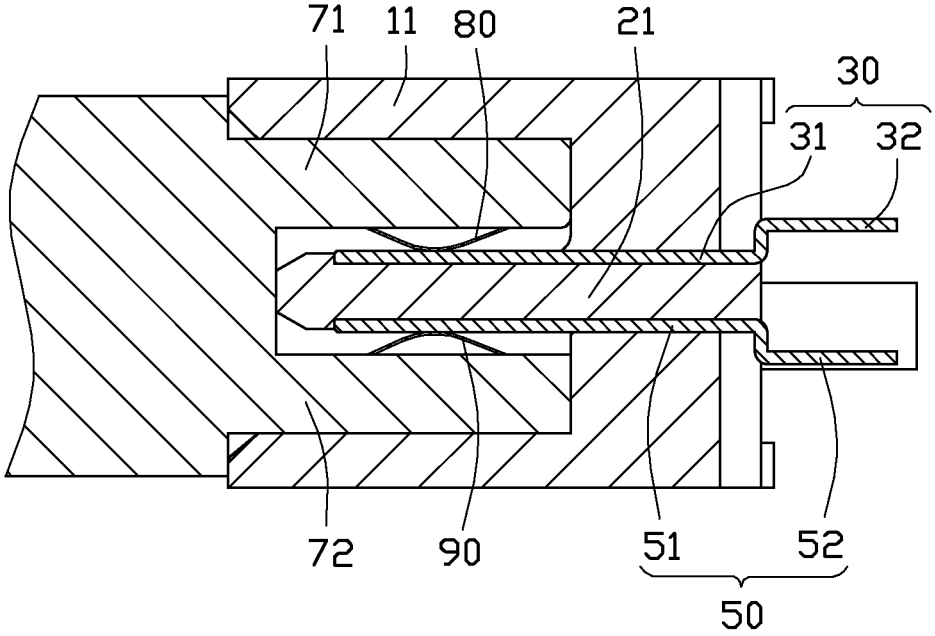
FIG. 4 is a cross-sectional view taken along the line IV-IV of FIG. 1.

FIG. 3 and FIG. 4, show in use, the USB plug 200 is moving towards the USB jack 100, and the insertion end 70 is adjacent to the USB jack 100. The insertion end 70 is inserted into the USB jack 100, until the insertion end 70 abuts the rear wall 13. The top plate 71 abuts the top wall 11. The bottom plate 72 abuts the bottom wall 12. The first positioning block 731 abuts the first sidewall 15 and is received between the first limiting block 111 and the third limiting block 123. The second positioning block 721 is received in a corner between the second limiting block 121 and the third limiting block 123. The installation piece 23 is received between the slot 711 and the bottom plate 72. The top plate 71 is received between the top wall 11 and the installation plate 21. The plurality of first resilient pieces 80 abuts the plurality of first pins 30 along a first direction. The bottom plate 72 is received between the installation plate 21 and the bottom wall 12. The plurality of second resilient pieces 90 abuts the plurality of second pins 50 along a second direction opposite to the first direction. Thus, the USB plug 200 is secured to the USB jack 100, and the USB plug 200 and the USB jack 100 are prevented from disconnecting.

It is to be understood, however, that even though numerous characteristics and advantages have been set forth in the foregoing description of embodiments, together with details of the structures and functions of the embodiments, the disclosure is illustrative only and changes may be made in detail, especially in the matters of shape, size, and arrangement of parts within the principles of the disclosure to the full extent indicated by the broad general meaning of the terms in which the appended claims are expressed.

What is claimed is:

1. A USB jack comprising:

a case adapted for receiving a USB plug and comprising a top wall and a bottom wall opposite to the top wall; and an installation plate located in the case and between the top wall and the bottom wall;

wherein a plurality of first pins is secured to a top surface of the installation plate facing the top wall, and a plurality of second pins is secured to a bottom surface of the installation plate facing the bottom wall; the plurality of first pins and the plurality of second pins abut a plurality of resilient pieces of the USB plug and are electronically connected with the plurality of resilient pieces of the USB plug along two opposite directions; the case further comprises a first sidewall connected to the top wall and the bottom wall, a first limiting block is located on the top wall, a second limiting block is located on the bottom wall, and a third limiting block extends from the second limiting block; the first limiting block, the second limiting block and the third limiting block are connected to the first sidewall, and the first limiting block and the third limiting block are adapted to secure a first positioning block of the USB plug therebetween.

2. The USB jack of claim 1, the case further comprises a rear wall connected to the top wall and the bottom wall, each of the plurality of first pins comprises a first end and second end, the first end is secured to the installation plate, and the second end extends out of the rear wall to connect a circuit board.

3. The USB jack of claim 1, the case further comprises a second sidewall substantially parallel to the first sidewall, a fourth limiting block is located on the bottom wall, and the fourth limiting block is connected to the second sidewall.

4. The USB jack of claim 1, wherein an installation piece extends from the installation plate, and the installation plate is adapted to be engaged in a slot of the USB plug.

5. The USB jack of claim 4, wherein the installation piece is substantially perpendicular to the installation plate.

6. A USB plug for a USB jack, comprising:

a bottom plate;

a top plate substantially parallel to the bottom plate;

a plurality of first resilient pieces secured to a bottom surface of the top plate facing the bottom plate; and a plurality of second resilient pieces secured to a top surface of the bottom plate facing the top plate;

wherein the plurality of first resilient pieces and the plurality of second resilient pieces are adapted to be connected to USB cables, and the plurality of first resilient pieces and the plurality of second resilient pieces abut a plurality of pins embedded into a predominantly two dimensional installation plate of the USB jack and are electronically connected with the plurality of pins of the USB jack along two opposite directions.

7. The USB plug of claim 6, further comprises a first side plate and a second side plate opposite to the first side plate, the first side plate and the second side plate are connected to the top plate and the bottom plate, and a first positioning block is located on the first side plate; and the first positioning block is adapted to be engaged between a first limiting block and a third limiting block of the USB jack.

8. The USB plug of claim 7, wherein the top plate defines a slot, the slot extends to the second side plate, and the slot is adapted to receive an installation piece of the USB jack.

9. The USB plug of claim 7, wherein a second positioning block is located on the bottom plate, and the second positioning block is adapted to be engaged between a second limiting block and the first limiting block of the USB jack.

10. The USB plug of claim 9, wherein the second positioning block is connected to the first positioning block.

11. A USB plug for a USB jack, comprising:

a bottom plate;

a top plate substantially parallel to the bottom plate;

a first side plate;

a second side plate opposite to the first side plate;

a plurality of first resilient pieces secured to a bottom surface of the top plate facing the bottom plate; and a plurality of second resilient pieces secured to a top surface of the bottom plate facing the top plate;

wherein the plurality of first resilient pieces and the plurality of second resilient pieces are adapted to be connected to USB cables, and the plurality of first resilient pieces and the plurality of second resilient pieces abut a plurality of pins of the USB jack and are electronically connected with the plurality of pins of the USB jack along two opposite directions; the first side plate and the second side plate are connected to the top plate and the bottom plate, and a first positioning block is located on the first side plate; and the first positioning block is adapted to be engaged between a first limiting block and a third limiting block of the USB jack; a second positioning block is located on the bottom plate, and the second positioning block is adapted to be engaged between a second limiting block and the first limiting block of the USB jack.

* * * * *